US006648666B1

(12) United States Patent
Wu

(10) Patent No.: US 6,648,666 B1
(45) Date of Patent: Nov. 18, 2003

(54) ELECTRICAL CONNECTOR HAVING A LATCH MECHANISM

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/227,044

(22) Filed: Aug. 23, 2002

Related U.S. Application Data

(63) Continuation-in-part of application No. 10/210,129, filed on Jul. 31, 2002.

(51) Int. Cl.[7] ..... H01R 6/27
(52) U.S. Cl. ..... 439/352; 439/357
(58) Field of Search ..... 439/352, 357, 439/350, 345, 157, 327, 358

(56) References Cited

U.S. PATENT DOCUMENTS 6,371,787 B1 * 4/2002 Branch et al. ..... 439/352
6,485,315 B1 * 11/2002 Hwang ..... 439/108

* cited by examiner

*Primary Examiner*—Alexander Gilman
(74) *Attorney, Agent, or Firm*—Wei Te Chung

(57) ABSTRACT

An electrical connector (1) includes a base (10) and a cover (20) assembled together and each define a pair of channels (121, 221) on opposite sides thereof. A pull tab (80) has an operation portion (81) and a pair of arms (82) extending from the operation portion. A pair of spring plates (85) is formed on inner sides of the arms. Four metal pieces (90) are received the spring plates and the arms. The pair of arms is received in the channels with the operation portion remaining outside. The spring plates abut against a rear portion (14) of the base. A pair of latch springs (70) engages with the pull tab. When the pull tab is pulled, the latch spring separates with a complementary connector, the spring plates and the metals pieces bent to deflective shapes. When the pull is released, the spring plates and the metals pieces resume to original shapes to motivate the pull tab to return back to an original position.

11 Claims, 10 Drawing Sheets

ELECTRICAL CONNECTOR HAVING A LATCH MECHANISM

CROSS-REFERENCE TO RELATED APPLICATIONS

The present invention is a continuation-in-part of the patent application entitled, "ELECTRICAL CONNECTOR HAVING A LATCH MECHANISM" by Jerry Wu, having Ser. No. 10/210129 and a filing date of Jul. 31, 2002, and assigned to the assignee of the present invention, and the content of which is incorporated herein by reference now. Other two related applications of which one was filed Aug. 12, 2002, both have the same title, the same applicant, and the same assignee as the invention, being the references herewith, too.

BACKGROUND OF THE INVENTION

1. Field of the Invention

The present invention relates to an electrical connector, and particularly to an electrical connector having a pull tab and a pair of latch springs for engaging and releasing a mated complementary connector.

2. Description of Prior Art

Referring to U.S. Pat. No. 5,564,939, a conventional electrical connector disclosed in the patent has a pair of latch springs 22 and 22A respectively attached on opposite sides of a housing 21 of the connector. An operating member 23 has a pair of latch releasing cams 23–4 located below angled portions 22–4 of the latch springs 22, 22A. When an operator pulls a pull tab 23–8 of the operating member 23 backwardly, the latch releasing cams 23–4 exert outward forces on the angled portions 22–4 and U-shaped claws 22–1 slip out to release a mated complementary connector. Because the operating member 23 and the latch springs 22, 22A are positioned outside of the housing 21, they are very easy to be damaged when a force is exerted thereon. When two or more such connectors are arranged side by side, a relatively large space is needed between every two connectors and this adversely affects the compact design of an electronic system including such connectors. Furthermore, when the pulling force acting on the operating member 23 is released, the latch springs 22, 22A exert a force to push the operating member 23 to its original position. However, the force is too small to exactly pull the operating member 23 to the original position. To overcome the above mentioned disadvantages, an electrical connector is needed that a pull tab of the connector can be automatically return to its original position, and a better protection is provided to the latch springs to prevent them from damage by an external force.

SUMMARY OF THE INVENTION

It is an objective of the present invention to provide an electrical connector having a pull tab engaging with a pair of latch springs for latching and releasing a mated complementary connector, the pull tab with the latch springs can automatically resume to original position after released the complementary connector.

In order to achieve the object above-mentioned, an electrical connector in accordance with the present invention comprises a base, an insulating housing, a cover assembled to the base, a pull tab and a pair of latch springs. The base has a pair of sidewalls, the sidewalls define a pair of elongated first channels. A mating frame is formed on a front portion of the base. The insulting housing is assembled into the mating frame and has a plurality of terminals received therein. The cover has a pair of sidewalls, the sidewalls define a pair of elongated second channels on opposite sides thereof corresponding to the first channels of the base. The pull tab has an operation portion and a pair of arms extending from a pair of ends of the operation portion. The pair of arms is respectively received in the first and second channels and the operation portion locates outside the base and the cover. Each arm has a latch releasing portion at a free end thereof and a resilient portion protruding inwardly from the arm. Each arm defines a slit extending into the resilient portion. A pair of metal pieces is fitted in the corresponding slits. The latch springs cooperate with the latch releasing portions for securely engaging with the complementary connector when said complementary connector mates with the electrical connector. When the pull tab is pulled backwards, the latch releasing portions push the latch springs to separate the complementary connector from the latch springs. The resilient portions and the metal pieces of the pull tab are bent to deflective shapes. When the pull tab is released, the resilient portions and the metal pieces resume to original positions to motivate the pull tab to return back to an original position .

Other objects, advantages and novel features of the invention will become more apparent from the following detailed description when taken in conjunction with the accompanying drawings.

DETAILED DESCRIPTION OF THE INVENTION

Figure 1:
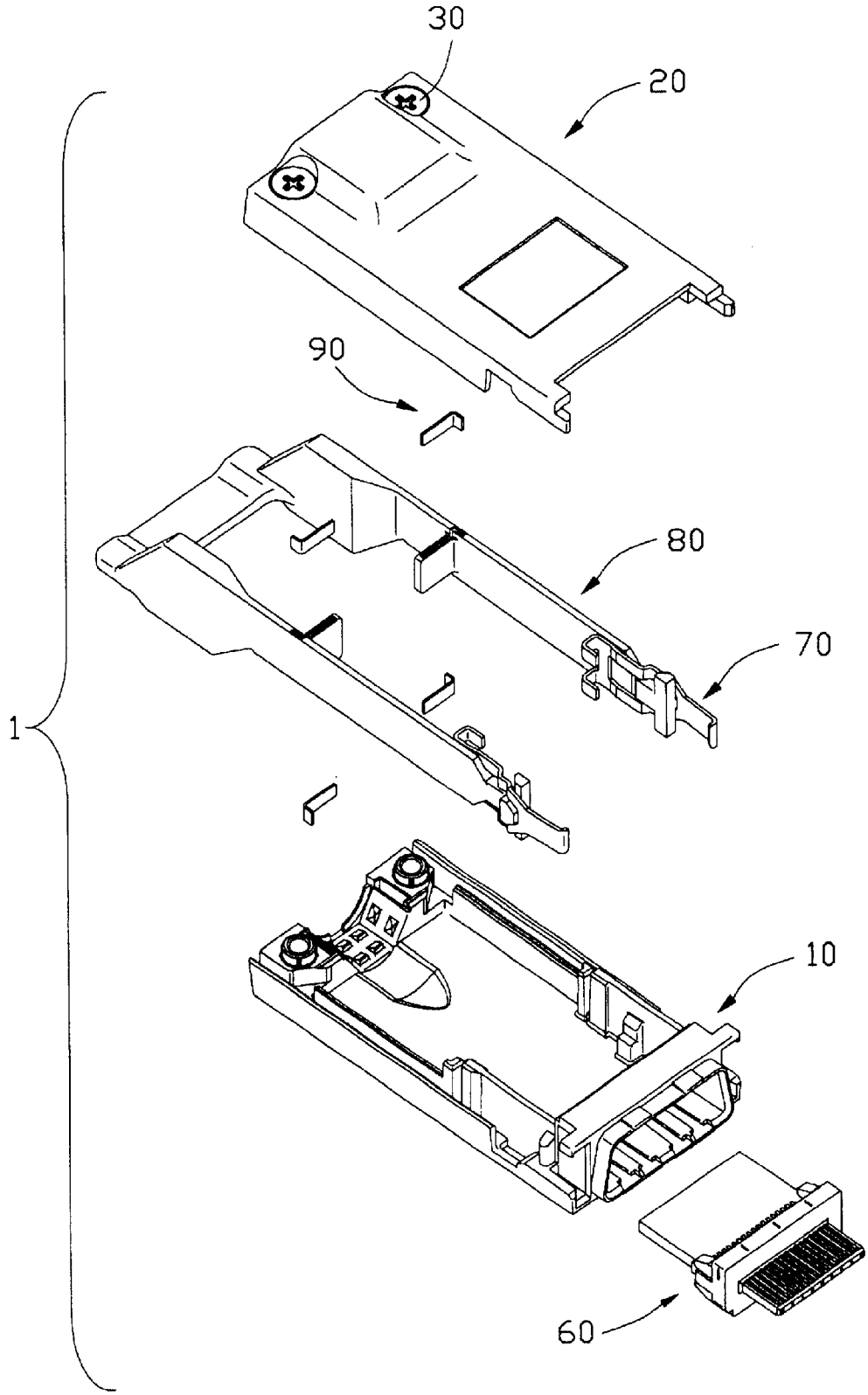
FIG. 1 is an exploded perspective view of an electrical connector in accordance with the present invention.

Referring to FIG. 1, an electrical connector 1 in accordance with the present invention comprises a base 10, a cover 20 for being assembled to the base 10, a pair of screws 30 for securing the cover 20 on the base 10, a connector subassembly 60, a latch spring 70, a pull tab 80, and four metal pieces 90.

Figure 2:
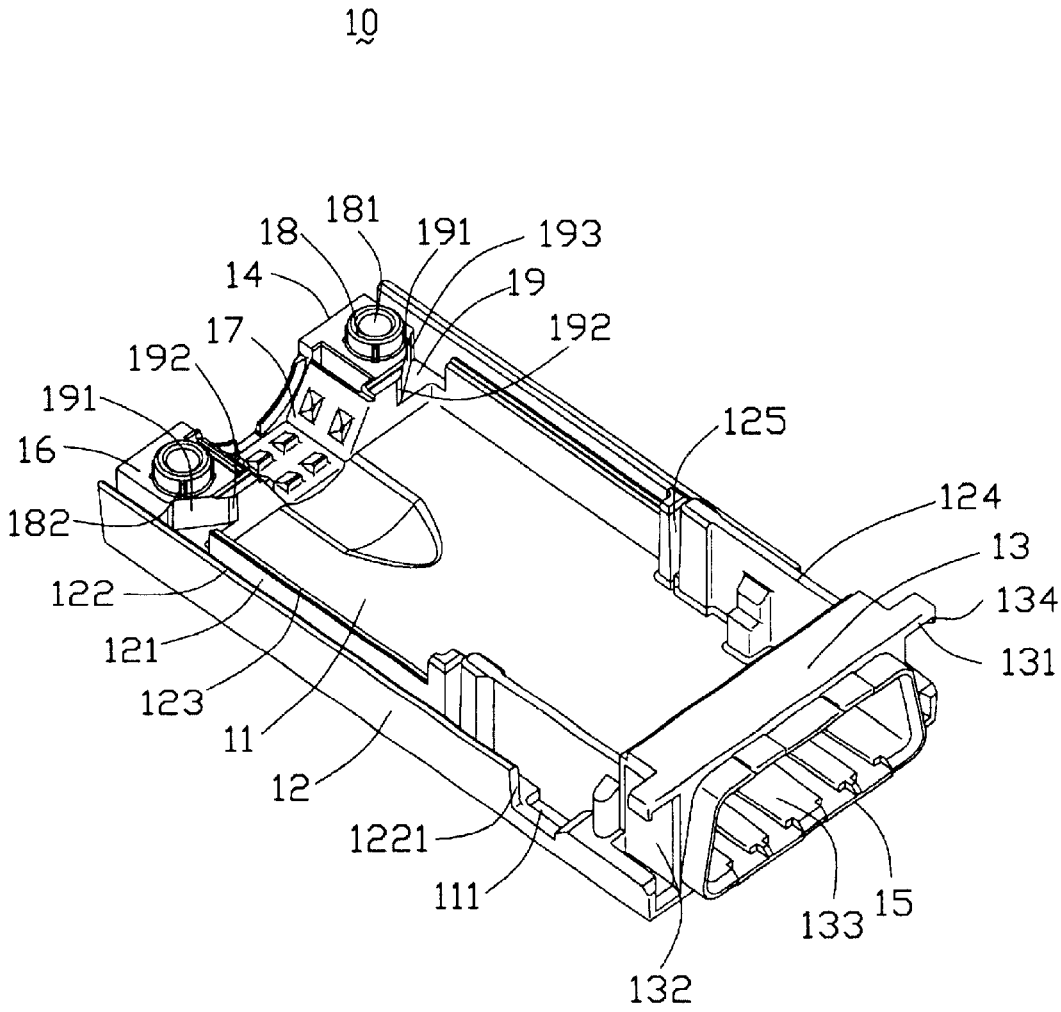
FIG. 2 is an enlarged perspective view of a base shown in FIG. 1.

The base 10 and the cover 20 are formed by die casting metallic material, for example, aluminum alloy. Referring to FIG. 2, the base 10 comprises a base plate 11 and a pair of sidewalls 12 upwardly extending from opposite lateral sides of the base plate 11. The base plate 11 and the pair of sidewalls 12 define an interior space (not labeled). Each sidewall 12 defines an elongated channel 121 from a rear portion 14 toward a front portion 15 of the base 10 and through a top engaging face 16 thereof. Each sidewall 12 is divided into an outer wall 122 and an inner wall 123 by the channel 121. The inner walls 123 each have a higher shoulder portion 124 adjacent to the front portion 15. The shoulder portions 124 each define a vertical slit 125 at a rear end thereof. The outer walls 122 each define a cutout 1221 adjacent to the front portion 15. The base plate 11 defines a pair of grooves 111 each being located between the shoulder portion 124 of a corresponding inner wall 123 and a corresponding cutout 1221. A mating frame 13 is formed at the front portion 15 of the base 10. The mating frame 13 defines an opening 133 through the front portion 15. A pair of engaging ears 131 is formed on opposite sides of a top of the mating frame 13 and extends laterally. Each engaging ear 131 has a protrusion 134 downwardly extending from a free end thereof. A pair of engaging spaces 132 is defined in opposite sides of the mating frame 13 and between the engaging ears 131 and the base plate 11. The base 10 has a first substantially semicircular opening 17 at the rear portion 14. A pair of posts 18 protrudes upwardly from the engaging face 16, located respectively at opposite sides of the first opening 17. Each post 18 defines a screw hole 181 therein and has four ribs 182 on a circumferential periphery thereof. The rear portion 14 defines a pair of depressions 19 on two opposite corners thereof which adjacent to the interior space. The depressions 19 are in communication with the channel 121 and the interior space. The rear portion 14 has a pair of inclined surfaces 191 on inner sides of the depressions 19. The rear portion 14 further has a pair of front supporting portions 192 on front ends of the inclined surfaces 191 and a pair of rear supporting portions 193 on rear ends of the inclined surfaces 191.

Figure 3:
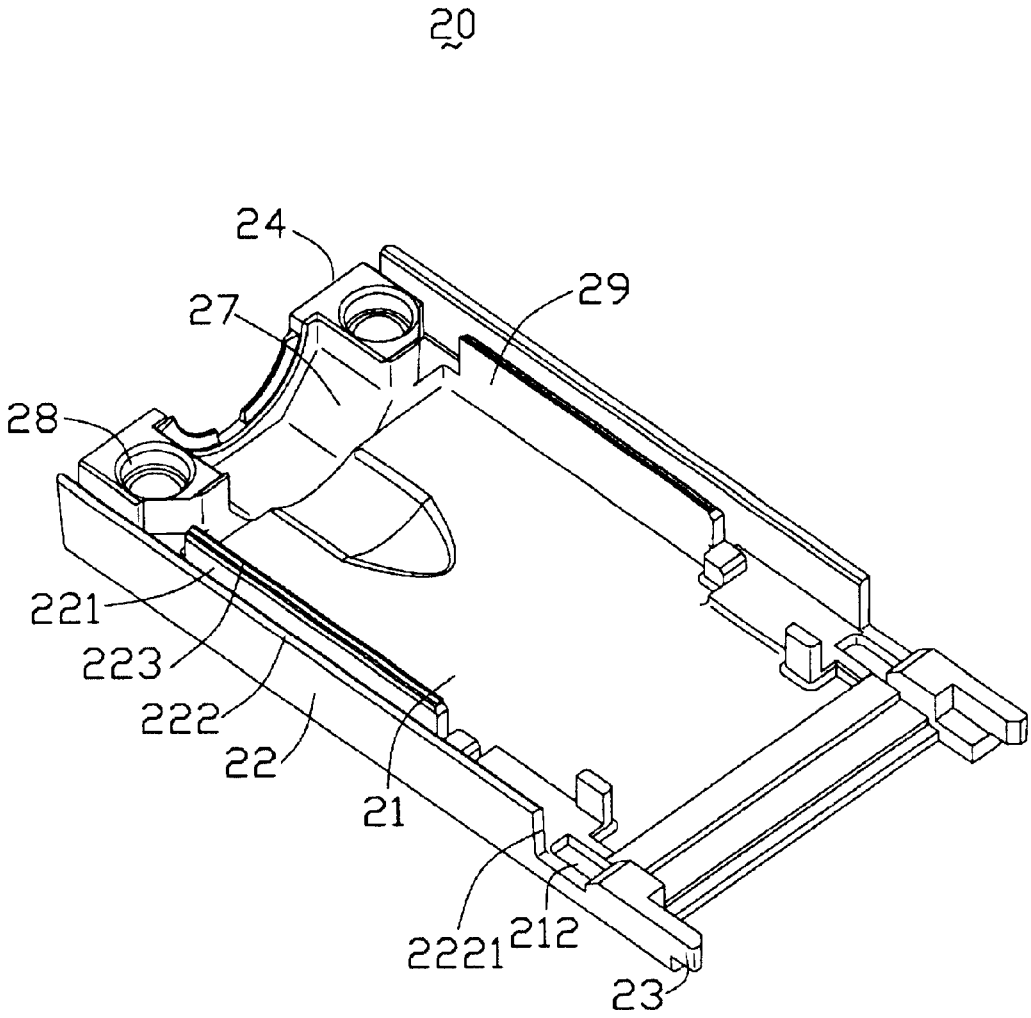
FIG. 3 is an enlarged perspective view of a cover shown in FIG. 1 from a bottom aspect

Referring to FIG. 3, the cover 20 comprises a cover plate 21 and a pair of sidewalls 22 downwardly extending from opposite lateral sides of the cover plate 21. Each sidewall 22 defines an elongated channel 221 corresponding to the channel 121 of the base 10. Each sidewall 22 is divided into an outer wall 222 and an inner wall 223 by the channel 221. A pair of grooves 212, corresponding to the grooves 111 of the base 10, is defined in the cover plate 21 in inner sides of a pair of cutouts 2221 which is corresponding to the cutouts 1211 in the base 10. A pair of projections 23 extends forwardly from opposite sides of a front end of the cover plate 21. A semicircular second opening 27 is defined in a rear portion 24 of the cover plate 21 corresponding to the first opening 17 of the base 10. A pair of holes 28 is defined in the rear portion 14, locating at opposite sides of the second opening 27. Each hole 28 has a diameter generally equal to an outer diameter of each of the posts 18. The rear portion 24 defines a pair of depressions 29 on two opposite corners thereof corresponding to the depressions 19 of the base 10. The depressions 29 have identical structures with the depressions 19 and will not be described here.

Figure 4:
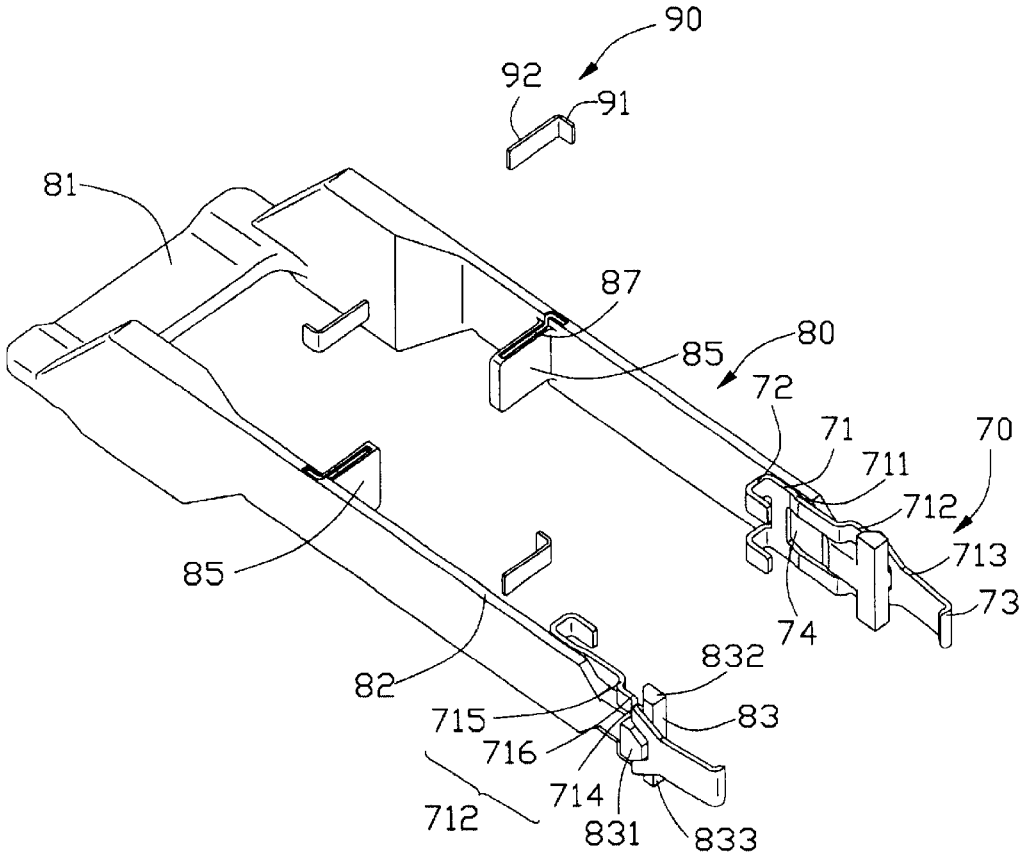
FIG. 4 is an enlarged perspective view of a pair of latch springs, a pull tab, and four metal pieces without being assembled into the pull tab shown in FIG. 1.

Referring to FIG. 4, each of the latch spring 70 is formed by stamping a metal sheet and has a body portion 71, a U-shaped claw portion 72 formed at a rear end of the body portion 71, and an L-shaped claw portion 73 formed at a front end of the body portion 71. An elongated cutout 74 is defined in the body portion 71 in a front-to-rear direction. The body portion 71 comprises a rear portion 711, a middle portion 712, and a front portion 713 extending inwardly from the middle portion 712. The middle portion 712 comprises a front slope portion 714, a rear slope portion 715 and an intermediate portion 716 between the front and rear slope portions 714 and 715.

The pull tab 80 is made of plastic material and comprises an operation portion 81, a pair of arms 82 extending forwardly from opposite sides of the operation portion 81, and a pair of latch releasing portion 83 formed at front ends of the arms 82, respectively. Each latch releasing portion 83 has upper and lower ends 832, 833 and a protrusion 831 protruding outwardly from an outside face thereof. Each arm 82 has a spring plate 85 extending from inner sides thereof and the two spring plates 85 extend toward each other. Each arm 82 defines a pair of slits 87 from top and bottom of the arm 82 and extending into the springs 85. The slits 87 in tops of the arms 82 extend along the arms 82 in opposite directions. The two slits 87 defined in top and bottom of one arm 82 extend also in opposite directions. Four L-shaped metal pieces 90 for being assembled into the slits 87 each comprise a retaining portion 91 and a spring portion 92 extending perpendicularly from the retaining portion 91.

Figure 5:
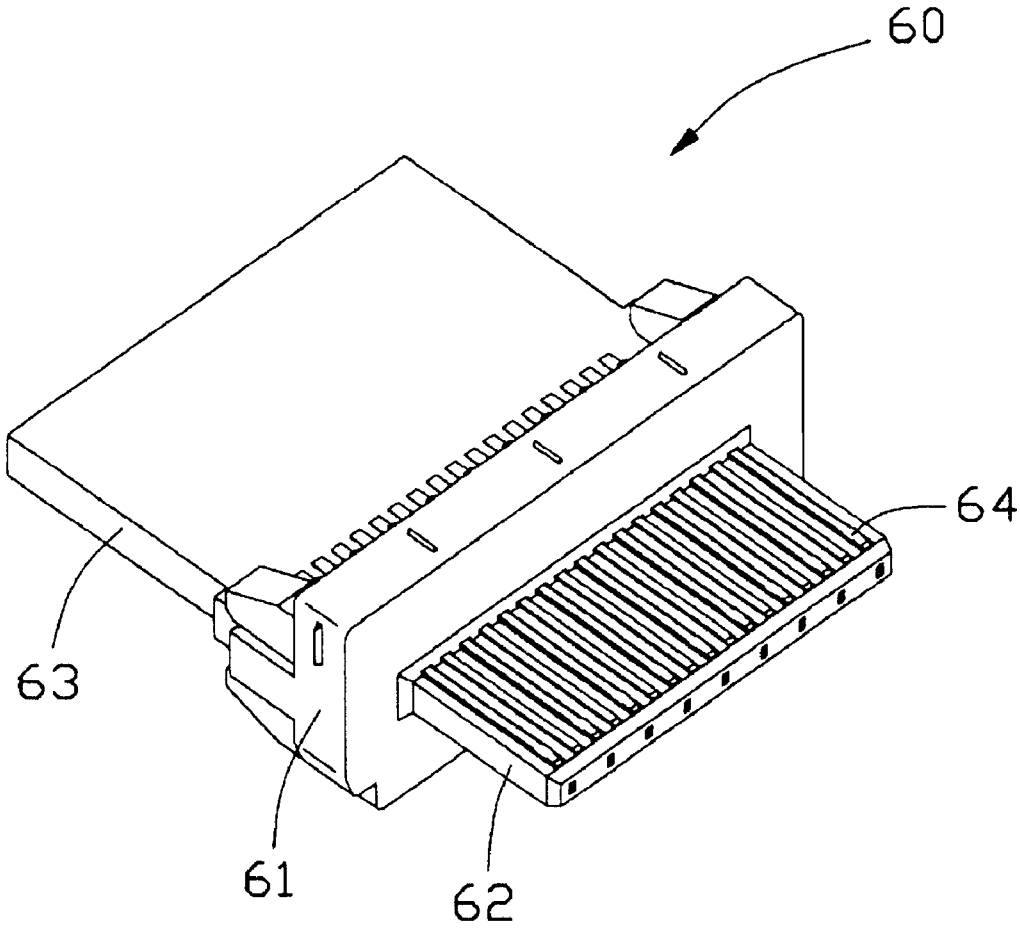
FIG. 5 is an enlarged perspective view of a connector subassembly shown in FIG. 1.
Figure 6:
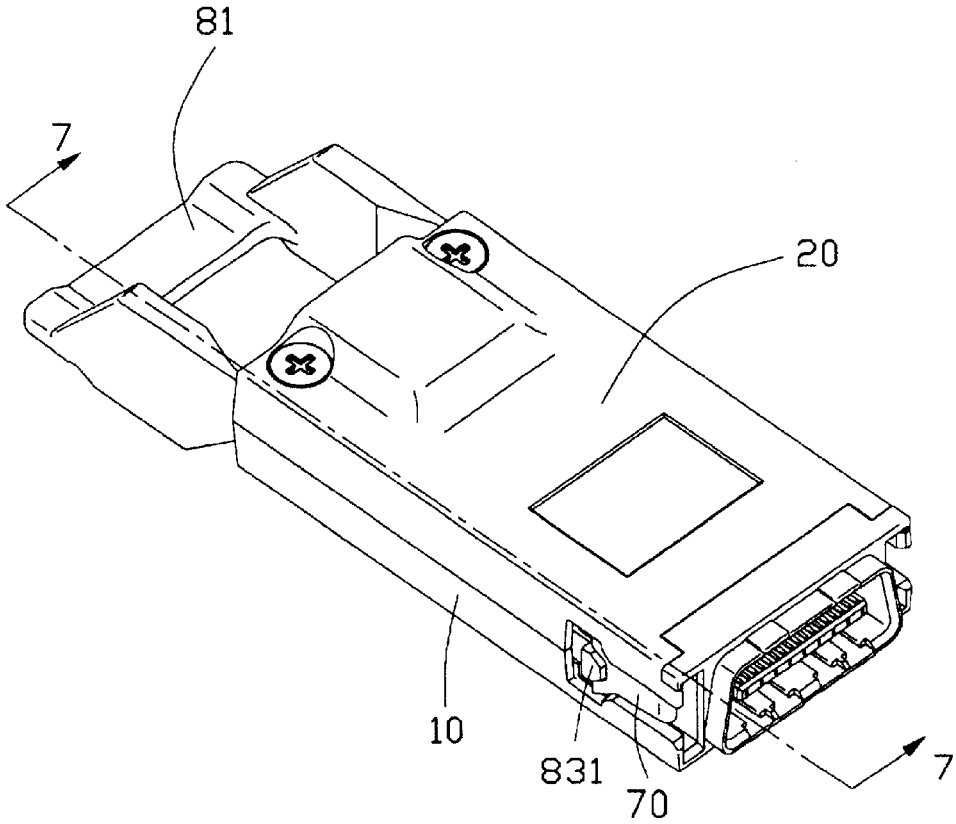
FIG. 6 is an assembled view of the electrical connector shown in FIG.
Figure 7:
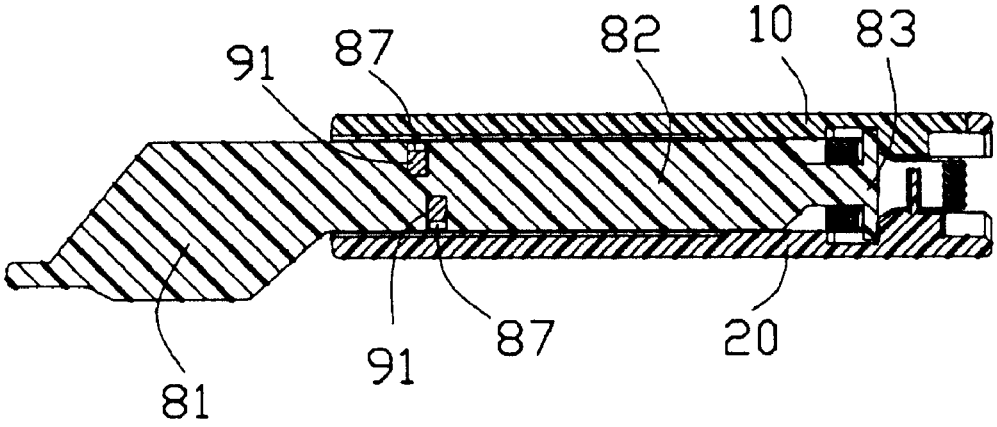
FIG. 7 is a cross-sectional view of FIG. 6 taken along line 7—7.

Referring to FIG. 5, the connector subassembly 60 comprises an insulating housing 61, a tongue portion 62 extending forwardly from the housing 61, a printed circuit board (PCB) 63 assembled to the housing 61 at a rear side thereof. A plurality of contacts 64 is received in the tongue portion 62 and extends through the housing 61 to electrically connect the PCB 63.

Referring to FIGS. 6–9, in assembly, the connector subassembly 60 is assembled to the base 10 with the tongue portion 62 received in the opening 133. The PCB 63 is received in the base 10 between the two sidewalls 12. The four metal pieces 90 are assembled to the slits 87 of the two arms 12 with the spring portions 92 received in the slits 87 locating in the arms 12 and the retaining portions 91 received in the slits 87 locating in the spring plates 85. The two latch springs 70 are respectively assembled to the pull tab 80 by extending the protrusions 831 of the latch releasing portions 83 into the cutouts 74 from inner faces of the latch springs 70, whereby the latch releasing portions 83 engage with the inner faces of the latch springs 70, respectively. The latch releasing portions 83 are positioned at inner faces of the front portions 713 and the protrusions 831 are fitted into front portions of the cutouts 74. Then, the latch springs 70 together with the pull tab 80 and the metal pieces 90 are assembled to the base 10. The arms 82 are placed into the channels 121 with the operation portion 81 locating outside of the rear portion 14 of the base 10. The spring plates 85 are fitted into the depressions 19 and free ends thereof abut against the front supporting portions 192. The U-shaped claw portions 72 are received into the slits 125 and engaged with the shoulder portions 124 to secure the latch springs 70. The L-shaped claw portions 73 extend into the engaging spaces 132. The cover 20 is assembled to the base 10 by placing the projections 23 beneath the pair of engaging ears 131. Then a rear portion of the cover 20 is rotated downwardly about the pair of engaging ears 131 until a bottom face of the cover 20 intimately abuts the top engaging face 16 of the base 10. Upper portions of the arms 82 are received in the channels 221, upper portions of the spring plates 85 are received into the depressions 29, and the upper tip ends 832 of the latch releasing portions 83 are received into the grooves 212 of the cover 20. The posts 18 are received into the holes 28 with the four ribs 182 engaging with inner surfaces of the holes 28. The first and second openings 17 and 27 together form a cable receiving opening for extension of a cable (not shown) therethrough. Finally, the screws 30 are screwed into the screw holes 181 to securely fasten the cover 20 and the base 10 together, whereby the electrical connector 1 in accordance with the present invention is obtained.

An operation of the electrical connector 1 in introduced below.

Figure 8:
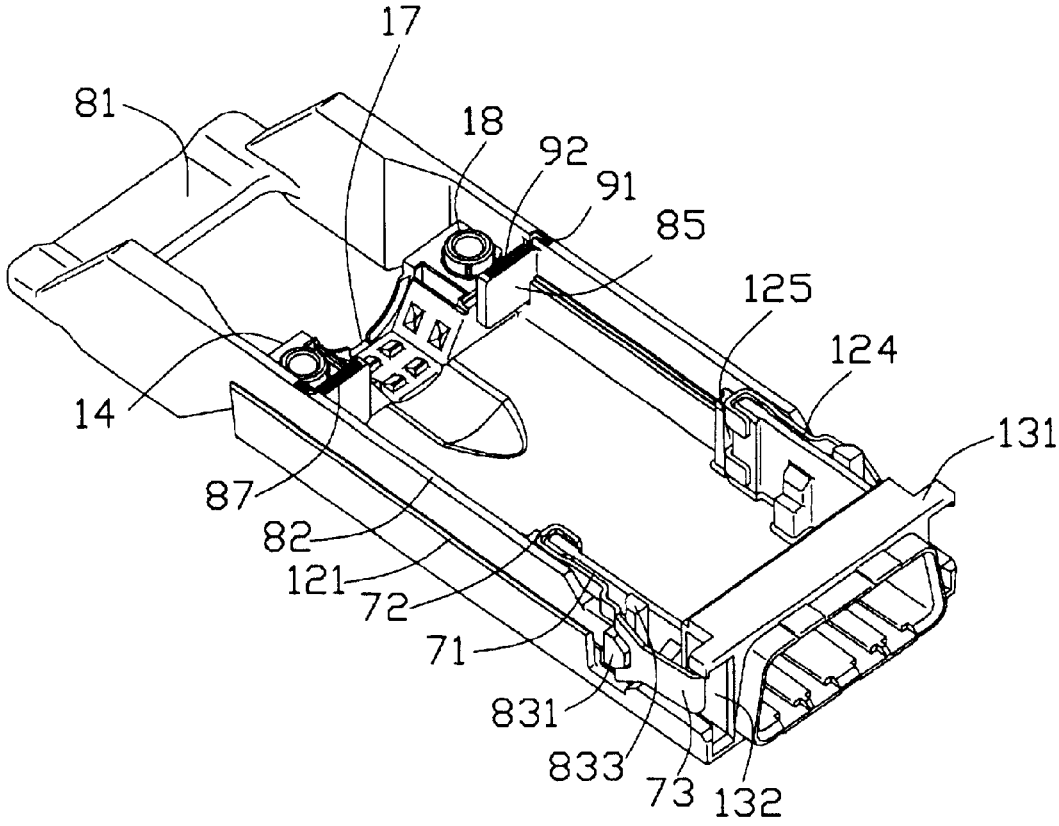
FIG. 8 is a view similar to FIG. 6 of the electrical connector with the cover and a connector subassembly being removed.
Figure 9:
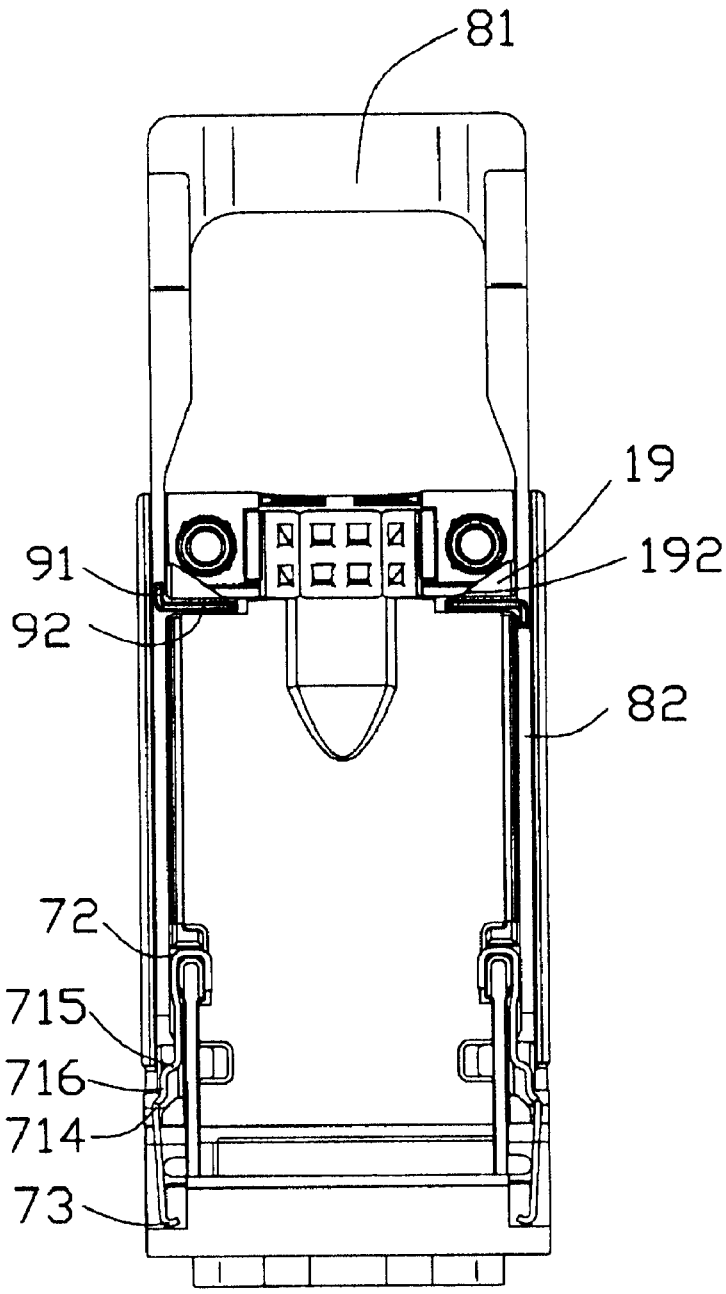
FIG. 9 is a top view of FIG. 8, with the latch springs in original position.
Figure 10:
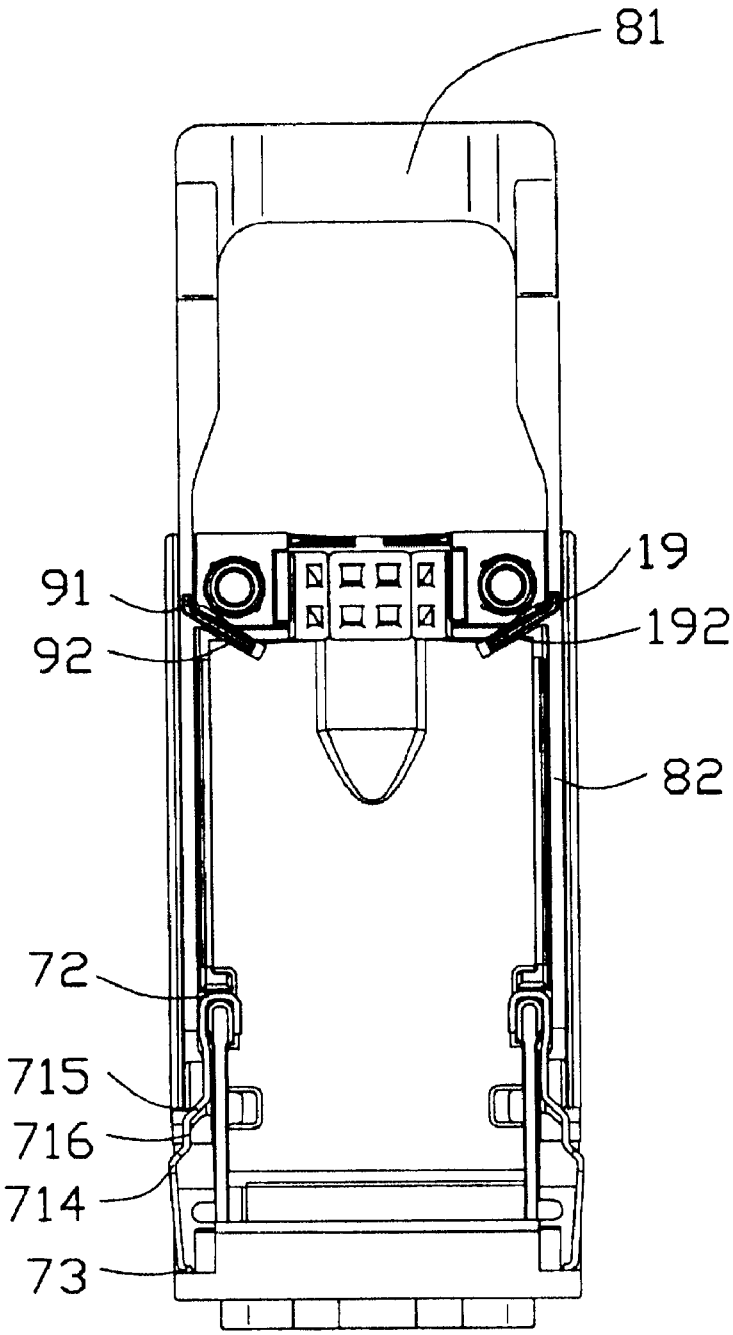
FIG. 10 is a view similar to FIG. 9, showing the latch springs in an open position, and a pair of springs plates and metal pieces in deflective positions.

Referring to FIGS. 8–10, when a complementary connector (not shown) is mated with the electrical connector 1 of the present invention, the L-shaped claw portions 73 clamp corresponding engaging portions of the complementary connector. The electrical connector 1 is unmated with the complementary connector by the following operation. An operator grips the operation portion 81 of the pull tab 80 and pull it rearwards, the pull tab 80 moves rearwards. The upper and lower ends 832, 833 slide in the grooves 111, 212 and the protrusions 831 slide in the cutouts 74. In the same time, the spring plates 85 and the spring portions 92 of the metal pieces 90 are elastically deformed and transmit a pull force to the front supporting portion 192. Then, the whole connector moves together with the pull tab 80. When the latch releasing portions 83 come into contact with the front slope portions 714, they exert an outward force on inner faces of the front slope portions 714. The latch springs 70 are elastically deformed and the front portions 713 are pushed out. The L-shaped claw portions 73 are driven to move out of the engaging portions of the complementary connector. When the latch releasing portions 83 slide on the intermediate portions 716, the intermediate portions 716 have an inward force exerted on the latch releasing portions 83. Accordingly, the latch springs 70 no longer latch with the complementary connector, and the electrical connector 1 in accordance with the present invention can be readily separated from the complementary connector as mentioned below.

When the pull tab 80 is pulled backwards, the spring plates 85 are bent to deflective shapes with free end portions of the spring plates 85 abutting against the front supporting portions 192 and junction potions between the spring plates 85 and arms 82 abutting against the rear supporting portions 193. So that a force pulling the pull tab 80 is transferred to the electrical connector 1 and the electrical connector 1 is pulled out from the complementary connector. When the pulling force acting on the pull tab 80 is released, a spring force of the spring portions 92 of the metal pieces 90 and the spring plates 85 of the pull tab 80 disappear so that the deflective shapes of the springs 85 and the springs portions 92 resume to original shapes and the pull tab 80 returns back to the original position shown in FIG. 9.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mating with a complementary connector, comprising:

a base having a pair of sidewalls, the sidewalls defining a pair of elongated first channels, a mating frame formed on a front portion of the base;

an insulting housing assembled into the mating frame and having a plurality of terminals received therein;

a cover assembled to the base;

a plastic tab having an operation portion and a pair of arms extending from a pair of ends of the operation portion, the pair of arms respectively received in the first channels and the operation portion locating outside the base and the cover, each arm having a latch releasing portion at a free end thereof and a resilient portion integrally formed on the arm and protruding inwardly from the arm, each arm defining a slit extending into the resilient portion, a pair of metal strengthen pieces fitted in the corresponding slits; and a pair of latch springs cooperating with the latch releasing portions and adapted for securely engaging with the complementary connector when said complementary connector mates with the electrical connector, when the pull tab is pulled backwards, the latch releasing portions pushing the latch springs adapted to separate the complementary connector from the latch springs, the resilient portions and the strengthen pieces of the pull tab bent to deflective shapes, when the pull tab is released, the resilient portions and strengthen pieces resuming to original shapes to motivate the pull tab to return back to an original position.

2. The electrical connector as described in claim 1, wherein the cover comprises a pair of sidewalls, the sidewalls define a pair of elongated second channels corresponding to the first channels of the base, the arms of the pull tab are received in first channels and the corresponding second channels.

3. The electrical connector as described in claim 2, wherein the base and the cover together define an interior space between the sidewalls of the base and the cover, the first and second channels are in communication with the receiving space.

4. The electrical connector as described in claim 3, wherein the resilient portions of the pull tab are a pair of spring plates protruding from inner sides of the arms and extending into the receiving space of the connector.

5. The electrical connector as described in claim 4, wherein the rear portion of the base has a pair of first supporting portions at a front end thereof and a pair of second supporting portions far away from the front end thereof, when the pull tab is pulled backward, the spring plates are pushed by the first supporting portions and bent to deflective shapes, till junction portions between the spring plates and the arms abut against the second supporting portion.

6. The electrical connector as described in claim 1, wherein the metal piece comprises a retaining portion received in the slit locating in the arm, and a spring portion perpendicularly extending from the retaining portion and received in the slit locating in the resilient portion.

7. The electrical connector as described in claim 1, wherein each latch spring has a first claw portion engaging with the base, a second claw portion adapted for engaging with the complementary connector and a sloping portion between the first and second claw portions and engaging with the latch releasing portion of the pull tab.

8. The electrical connector as described in claim 7, wherein the latch spring defines a cutout in the sloping portion, the arms of the pull tab run through the cutout from an outside face to an inside face of the sloping portion, so that the latch releasing portion contacts with the inside face of the sloping portion of the latch spring.

9. The electrical connector as described in claim 8, wherein the sloping portion comprises a front slope portion, a rear slope portion and an intermediate portion between the front and rear slope portions, when the pull tab is pulled backwardly, the latch releasing portions push the front slope portions sidewardly to separate the second claw portions from the mated complementary connector, when the latch releasing portions contact with the intermediate portions, the intermediate portions exert inward force on the latch releasing portions.

10. An electrical connector comprising:

a base/cover assembly defining a receiving space;

an insulating housing disposed in front portion of the receiving space;

a plastic tab mounted on the base/cover assembly and slidable in a front-to-back direction;

at least one latch spring mounted on the base/cover assembly, the latch spring is deflectable in lateral direction perpendicular to the front-to-back direction when the pull tab moves backwardly;

said pull tab has at least one spring plate engaging with at least one of the base/cover assembly and the insulating housing, the pull tab and the spring plate defining a slit to receive a metal strengthen piece therein, when the pull tab move backwardly, the spring plate and the strengthen piece are elastically deformed, the pull tab is recoverable because of the spring plate and the strengthen piece resuming to original position.

11. An electrical connector comprising:

a base/cover assembly defining a receiving space;

an insulating housing disposed in front portion of the receiving space;

a pull tab mounted on the base/cover assembly and slidable in a front-to-back direction;

at least one latch spring mounted on the base/cover assembly, the latch spring is deflectable in lateral direction perpendicular to the front-to-back direction when the pull tab moves backwardly; and one hybrid type spring plate comparing a plastic plate with an associated co-moveable embedded reinforcement metal plate thereof, being secured to one of the pull tab and the base/cover assembly and adapted to abut against the other of the pub tab and the base/cover when said pull tab is moved rearwardly, by a force, relative to the base/cover assembly so as to guarantee the pull tab being back to an original position thereof once said force is removed, thus allowing the latch spring to be back in an undeformed state.

* * * * *